US009839989B2

(12) United States Patent
Scott

(10) Patent No.: US 9,839,989 B2
(45) Date of Patent: Dec. 12, 2017

(54) METHODS OF FABRICATING CUTTING ELEMENTS INCLUDING ADHESION MATERIALS FOR EARTH-BORING TOOLS

(71) Applicant: Baker Hughes Incorporated, Houston, TX (US)

(72) Inventor: Danny E. Scott, Montgomery, TX (US)

(73) Assignee: Baker Hughes Incorporated, Houston, TX (US)

( * ) Notice: Subject to any disclaimer, the term of this patent is extended or adjusted under 35 U.S.C. 154(b) by 466 days.

(21) Appl. No.: 14/482,955

(22) Filed: Sep. 10, 2014

(65) Prior Publication Data

US 2015/0075082 A1 Mar. 19, 2015

Related U.S. Application Data

(60) Division of application No. 14/062,133, filed on Oct. 24, 2013, now Pat. No. 8,851,208, which is a (Continued)

(51) Int. Cl.
*E21B 10/567* (2006.01)
*B24D 3/00* (2006.01)
(Continued)

(52) U.S. Cl.
CPC ..... *B24D 3/007* (2013.01); *B24D 3/10* (2013.01); *B24D 18/0009* (2013.01);
(Continued)

(58) Field of Classification Search
CPC ... B24D 3/007; B24D 18/0009; E21B 10/567; E21B 10/5735; B22F 2005/001; B22F 2998/00
See application file for complete search history.

(56) References Cited

U.S. PATENT DOCUMENTS 3,745,623 A 7/1973 Wentorf et al.
4,151,686 A 5/1979 Lee et al.
(Continued)

FOREIGN PATENT DOCUMENTS

EP 579376 A1 5/1999
EP 1116858 A1 2/2005
(Continued)

OTHER PUBLICATIONS

International Search Report for International Application No. PCT/US2010/029320 dated Jun. 29, 2010, 3 pages.
(Continued)

*Primary Examiner* — Pegah Parvini
(74) *Attorney, Agent, or Firm* — TraskBritt

(57) ABSTRACT

A cutting element for an earth-boring drill bit may include a thermally stable cutting table comprising a polycrystalline diamond material. The polycrystalline diamond material may consist essentially of a matrix of diamond particles bonded to one another and a silicon, silicon carbide, or silicon and silicon carbide material located within interstitial spaces among interbonded diamond particles of the matrix of diamond particles. The cutting table may be at least substantially free of Group VIII metal or alloy catalyst material. The cutting element may further include a substrate and an adhesion material between and bonded to the cutting table and the substrate. The adhesion material may include diamond particles bonded to one another and to the cutting table and the substrate after formation of the preformed cutting table.

14 Claims, 3 Drawing Sheets

Related U.S. Application Data continuation of application No. 12/751,520, filed on Mar. 31, 2010, now Pat. No. 8,573,333.

(60) Provisional application No. 61/165,382, filed on Mar. 31, 2009.

(51) Int. Cl.

| | |
|---|---|
| ***E21B 10/573*** | (2006.01) |
| ***E21B 10/55*** | (2006.01) |
| ***B24D 3/10*** | (2006.01) |
| ***B24D 18/00*** | (2006.01) |
| ***B24D 99/00*** | (2010.01) |
| *B22F 5/00* | (2006.01) |

(52) U.S. Cl.

CPC ..... *B24D 99/005* (2013.01); *E21B 10/55* (2013.01); *E21B 10/567* (2013.01); *E21B 10/5735* (2013.01); *B22F 2005/001* (2013.01); *B22F 2998/00* (2013.01)

(56) References Cited

U.S. PATENT DOCUMENTS

| | | | | |
|---|---|---|---|---|
| 4,224,380 | A | 9/1980 | Bovenkerk et al. | |
| RE32,380 | E | 3/1987 | Wentorf et al. | |
| 4,766,040 | A | 8/1988 | Hillert et al. | |
| 4,793,828 | A | 12/1988 | Burnand | |
| 5,020,394 | A | 6/1991 | Nakamura et al. | |
| 5,127,923 | A | 7/1992 | Bunting et al. | |
| 5,435,403 | A | 7/1995 | Tibbitts | |
| 5,469,927 | A | 11/1995 | Griffin | |
| 5,486,137 | A | 1/1996 | Flood et al. | |
| 5,743,346 | A | 4/1998 | Flood et al. | |
| 5,950,747 | A | 9/1999 | Tibbitts et al. | |
| 6,021,859 | A | 2/2000 | Tibbitts et al. | |
| 6,065,552 | A | 5/2000 | Scott et al. | |
| 6,189,634 | B1 | 2/2001 | Bertagnolli et al. | |
| 6,248,447 | B1 * | 6/2001 | Griffin | C04B 37/021 175/434 |
| 6,258,139 | B1 | 7/2001 | Jensen | |
| 6,447,560 | B2 | 9/2002 | Jensen et al. | |
| 6,544,308 | B2 | 4/2003 | Griffin et al. | |
| 6,601,662 | B2 | 8/2003 | Matthias et al. | |
| 6,846,341 | B2 | 1/2005 | Middlemiss | |
| 6,986,297 | B2 | 1/2006 | Scott | |
| 7,350,601 | B2 | 4/2008 | Belnap et al. | |
| 7,377,341 | B2 | 5/2008 | Middlemiss et al. | |
| 7,407,012 | B2 | 8/2008 | Keshavan et al. | |
| 7,462,003 | B2 | 12/2008 | Middlemiss | |
| 7,473,287 | B2 | 1/2009 | Belnap et al. | |
| 7,475,744 | B2 | 1/2009 | Pope | |
| 7,506,698 | B2 | 3/2009 | Eyre et al. | |
| 7,517,589 | B2 | 4/2009 | Eyre | |
| 7,533,740 | B2 | 5/2009 | Zhang | |
| 7,608,333 | B2 | 10/2009 | Eyre | |
| 7,628,234 | B2 | 12/2009 | Middlemiss | |
| 7,681,669 | B2 | 3/2010 | Cannon et al. | |
| 7,726,421 | B2 | 6/2010 | Middlemiss | |
| 7,754,333 | B2 | 7/2010 | Eyre et al. | |
| 7,942,219 | B2 | 5/2011 | Keshavan et al. | |
| 7,998,573 | B2 | 8/2011 | Qian et al. | |
| 8,034,136 | B2 | 10/2011 | Sani | |
| 8,197,936 | B2 | 6/2012 | Keshavan | |
| 8,267,204 | B2 | 9/2012 | Lyons | |
| 8,573,333 | B2 | 11/2013 | Scott | |
| 2001/0037609 | A1 | 11/2001 | Jensen et al. | |
| 2003/0129780 | A1 | 7/2003 | Auberton-Herve | |
| 2003/0183426 | A1 | 10/2003 | Griffin et al. | |
| 2003/0196385 | A1 | 10/2003 | Middlemiss | |
| 2004/0172885 | A1 | 9/2004 | Middlemiss | |
| 2005/0115744 | A1 | 6/2005 | Griffin et al. | |
| 2006/0060390 | A1 | 3/2006 | Eyre | |
| 2006/0060391 | A1 | 3/2006 | Eyre et al. | |
| 2006/0086540 | A1 | 4/2006 | Griffin et al. | |
| 2006/0157286 | A1 * | 7/2006 | Pope | E21B 10/567 175/374 |
| 2006/0266558 | A1 * | 11/2006 | Middlemiss | B22F 7/062 175/426 |
| 2007/0023206 | A1 | 2/2007 | Keshavan | |
| 2007/0181348 | A1 | 8/2007 | Lancaster et al. | |
| 2008/0085407 | A1 | 4/2008 | Cooley et al. | |
| 2008/0115421 | A1 | 5/2008 | Sani | |
| 2008/0206576 | A1 | 8/2008 | Qian et al. | |
| 2008/0230280 | A1 | 9/2008 | Keshavan et al. | |
| 2009/0152018 | A1 | 6/2009 | Sani | |
| 2009/0313908 | A1 | 12/2009 | Zhang et al. | |
| 2010/0012389 | A1 | 1/2010 | Zhang et al. | |
| 2010/0126779 | A1 | 5/2010 | Corbett et al. | |
| 2010/0146865 | A1 | 6/2010 | Sato et al. | |
| 2010/0196717 | A1 * | 8/2010 | Liversage | B01J 3/065 428/408 |
| 2010/0243337 | A1 | 9/2010 | Scott | |
| 2010/0300767 | A1 | 12/2010 | Cariveau et al. | |
| 2011/0031033 | A1 * | 2/2011 | Mourik | C22C 26/00 175/428 |
| 2011/0042147 | A1 | 2/2011 | Fang et al. | |
| 2011/0259648 | A1 | 10/2011 | Sani | |
| 2012/0000136 | A1 | 1/2012 | Sani | |
| 2013/0313027 | A1 | 11/2013 | Sani | |
| 2014/0048341 | A1 | 2/2014 | Scott | |

FOREIGN PATENT DOCUMENTS

| | | | |
|---|---|---|---|
| GB | 2423542 | A | 8/2006 |
| JP | 59219500 | A | 12/1984 |
| WO | 9323204 | A1 | 11/1993 |
| WO | 2004106003 | A1 | 12/2004 |
| WO | 2004106004 | A1 | 12/2004 |
| WO | 2005110648 | A2 | 11/2005 |
| WO | 2008063568 | A1 | 5/2008 |
| WO | 2008079205 | A1 | 7/2008 |

OTHER PUBLICATIONS

International Written Opinion for International Application No. PCT/US2010/029320 dated Jun. 29, 2011, 6 pages.

International Preliminary Report on Patentability for International Application No. PCT/US2010/029320 dated Oct. 4, 2011, 6 pages.

Supplementary European Search Report for European Application No. 10762207 dated Oct. 2, 2014, 2 pages.

European Communication Pursuant to Article 94(3) EPC for European Application No. 10762207.8, dated Jun. 6, 2017, 4 pages.

* cited by examiner

METHODS OF FABRICATING CUTTING ELEMENTS INCLUDING ADHESION MATERIALS FOR EARTH-BORING TOOLS

CROSS-REFERENCE TO RELATED APPLICATIONS

This application is a divisional of U.S. patent application Ser. No. 14/062,133, flied Oct. 24, 2013, now U.S. Pat. No. 8,851,208, issued Oct. 7, 2014, which application is a continuation of U.S. patent application Ser. No. 12/751,520, filed Mar. 31, 2010, now U.S. Pat. No. 8,573,333, issued on Nov. 5, 2013, which is a utility conversion of U.S. Provisional Patent Application Ser. No. 61/165,382, filed Mar. 31, 2009, for "Methods For Bonding Preformed Cutting Tables to Cutting Element Substrates and Cutting Elements Formed by Such Processes," the disclosure of each of which is incorporated in this disclosure in its entirety by this reference.

FIELD

The present disclosure relates generally to cutting elements, or cutters, for use with earth-boring drill bits and, more specifically, to cutting elements that include thermally stable, preformed superabrasive cutting tables adhered to substrates with diamond. The present disclosure also relates to methods for manufacturing such cutting elements, as well as to earth-boring drill bits that include such cutting elements.

BACKGROUND

Conventional polycrystalline diamond compact (PDC) cutting elements include a cutting table and a substrate. The substrate conventionally comprises a metal material, such as tungsten carbide, to enable robust coupling of the PDC cutting elements to a bit body. The cutting table typically includes randomly oriented, mutually bonded diamond (or, sometimes, cubic boron nitride (CBN)) particles that have also been adhered to the substrate on which the cutting table is formed, under extremely high-temperature, high-pressure (HTHP) conditions. Cobalt binders, also known as catalysts, have been widely used to initiate bonding of superabrasive particles to one another and to the substrates. Although the use of cobalt in PDC cutting elements has been widespread, PDC cutting elements having cutting tables that include cobalt binders are not thermally stable at the typically high operating temperatures to which the cutting elements are subjected due to the greater coefficient of thermal expansion of the cobalt relative to the superabrasive particles and, further, because the presence of cobalt tends to initiate back-graphitization of the diamond in the cutting table when a temperature above about 750° C. is reached. As a result, the presence of the cobalt results in premature wearing of and damage to the cutting table.

A number of different approaches have been taken to enhance the thermal stability of polycrystalline diamond and CBN cutting tables. One type of thermally stable cutting table that has been developed includes polycrystalline diamond sintered with a carbonate binder, such as a Mg, Ca, Sr, or Ba carbonate binder. The use of a carbonate binder increases the pressure and/or temperature required to actually bind diamond particles to one another, however. Consequently, the diameters of PDC cutting elements that include carbonate binders lack an integral carbide support or substrate and are typically much smaller than the diameters of PDC cutting elements that are manufactured with cobalt.

Another type of thermally stable cutting table is a PDC from which the cobalt binder has been removed, such as by acid leaching or electrolytic removal. Such cutting elements have a tendency to be somewhat fragile, however, due to their lack of an integral carbide support or substrate and, in part, due to the removal of substantially all of the cobalt binder, which may result in a cutting table with a relatively low diamond density. Consequently, the practical size of a cutting table from which the cobalt may be effectively removed is limited.

Yet another type of thermally stable cutting table is similar to that described in the preceding paragraph, but the pores resulting from removal of the cobalt have been filled with silicon and/or silicon carbide. Examples of this type of cutting element are described in U.S. Pat. Nos. 4,151,686 and 4,793,828. Such cutting tables are more robust than those from which the cobalt has merely leached, but the silicon precludes easy attachment of the cutting table to a supporting substrate.

SUMMARY

The present disclosure includes embodiments of methods for adhering thermally stable diamond cutting tables to cutting element substrates. As used herein, the phrase "thermally stable" includes polycrystalline diamond cutting tables in which abrasive particles (e.g., diamond crystals, etc.) are secured to each other with carbonate binders, as well as cutting tables that consist essentially of diamond, such as cutting tables from which the cobalt has been removed, with or without a silicon or silicon carbide backfill, or that are formed by chemical vapor deposition (CVD) processes.

Some embodiments of such methods include preparation of the surface of a substrate to which a cutting table is to be bound before the cutting table is secured to that surface. In specific embodiments, preparation of the surface of the substrate may include removal of one or more contaminants or materials from the surface that may weaken or otherwise interfere with optimal bonding of the cutting table to the surface. In other specific embodiments, a substrate surface may be prepared to receive a cutting table by increasing a porosity or an area of the surface.

In such methods, preformed cutting tables, which are also referred to herein as "wafers," are secured, under HTHP conditions, to substrates (e.g., tungsten carbide, etc.) with an intermediate layer of diamond grit. In some embodiments, a powder, particles, or a thin element (e.g., foil, etc.) comprising cobalt or another suitable binder may be used with the diamond grit. In other embodiments, cobalt or another suitable binder material that is present (e.g., as part of a binder, etc.) in the substrate may be caused to sweep into the cutting table as heat and pressure are applied to the cutting table. In further embodiments, a preformed diamond wafer formed by a CVD process may be disposed on a surface of a conventional PDC cutting table previously formed on a substrate. The CVD wafer may then be bonded to the PDC cutting table under HTHP conditions.

The present disclosure also includes various embodiments of cutting elements. One embodiment of a cutting element according to the present disclosure includes a substrate, a thermally stable cutting table and an adhesion layer therebetween. The adhesion layer includes diamond particles bonded to the diamonds of the thermally stable cutting table and to the substrate. In addition to diamond, the adhesion layer may include cobalt. The substrate may comprise a cemented carbide, such as tungsten carbide with a suitable binder, such as cobalt. In another embodiment, a preformed cutting table comprising CVD diamond and bonded to a PDC layer comprising cobalt under HTHP conditions is carried by a cemented carbide substrate.

Other features and aspects, as well as advantages, of embodiments of the present disclosure will become apparent to those of ordinary skill in the art through consideration of the ensuing description, the accompanying drawings, and the appended claims.

DETAILED DESCRIPTION

Figure 1:
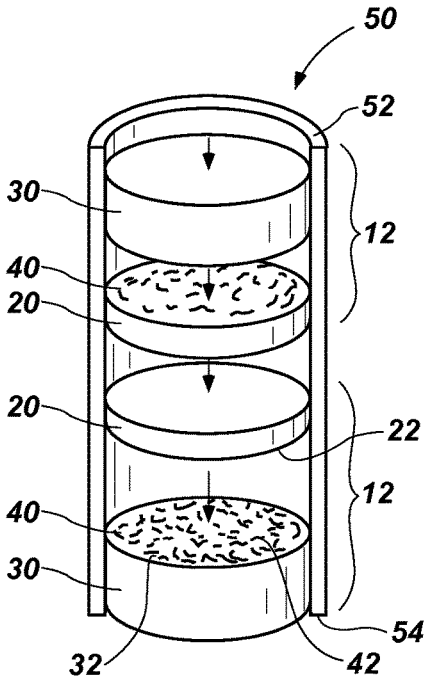
FIGS. 1 and 1A illustrate an embodiment of a process for manufacturing PDC cutting elements from preformed cutting tables, with a specific embodiment of preformed cutting table being shown.

With reference to FIG. 1, an embodiment of a process for securing a preformed cutting table 20 to a substrate 30 is illustrated. In that process, at least one "cutter set," which includes a substrate 30 and its corresponding preformed cutting table 20, is assembled.

Figure 1A:
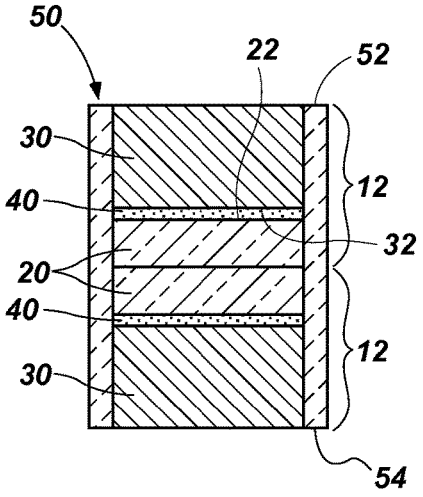

In the method of FIGS. 1 and 1A, at least one substrate 30 is introduced into a canister assembly, or synthesis cell assembly 50, formed from a refractory metal or other material that will withstand and substantially maintain its integrity (e.g., shape and dimensions) when subjected to HTHP processing. Each substrate 30 may comprise a cemented carbide (e.g., tungsten carbide) substrate for a PDC cutting element, or any other material that is known to be useful as a substrate for PDC cutting elements. In some embodiments, substrate 30 may include a binder material, such as cobalt.

Particles 40 of diamond grit are placed on substrate 30. More specifically, particles 40 are placed on a surface 32 to which a preformed cutting table 20 is to be secured. Particles 40 may be placed on surface 32 alone or with a fine powder or particles 42 of a suitable, known binder material, such as cobalt, another Group VIII metal, such as nickel or iron, or alloys including these materials (e.g., Ni/Co, Co/Mn, Co/Ti, Co/Ni/V, Co/Ni, Fe/Co, Fe/Mn, Fe/Ni, Fe (Ni.Cr), $Fe/Si_2$, Ni/Mn, Ni/Cr, etc.).

Surface 32 may be processed to enhance subsequent adhesion of a preformed cutting table 20 thereto. Such processing of surface 32 may, in some embodiments, include removal of one or more contaminants or materials that may weaken or otherwise interfere with optimal bonding of cutting table 20 to surface 32. In specific embodiments, metal carbonate binder, silicon, and/or silicon carbide may be removed from surface 32 of substrate 30, as these materials may inhibit diamond-to-diamond intergrowth, which is desirable for adhering preformed cutting table 20 to surface 32 of substrate 30. The removal of such materials may be effected substantially at surface 32. In such embodiments, one or more materials may be removed to a depth, from surface 32 into substrate 30, that is about the same as a dimension of a diamond particle of preformed cutting table 20, or to a depth of about one micron to about ten microns. In other embodiments, the removal of undesirable materials may extend beyond surface 32, and into substrate 30. Such preparation, in even more specific embodiments, may include leaching of one or more materials from the surface of the substrate.

In other embodiments, an area of surface 32 of substrate 30 may be increased. Chemical, electrical, and/or mechanical processes may, in some embodiments, be used to increase the area of surface 32 by removing material from surface 32. Specific embodiments of techniques for increasing the area of surface 32 include, but are not limited to, laser ablation of surface 32, blasting surface 32 with abrasive material, and exposing surface 32 to chemically etchants.

The removal of such materials may, in some embodiments, enable cobalt or another binder to penetrate into substrate 30 to facilitate the bonding of preformed cutting table 20 to surface 32.

A base surface 22 of preformed cutting table 20 is placed over particles 40 on surface 32 of substrate 30. Base surface 22 of preformed cutting table 20 is of a complementary topography to the topography of surface 32 of substrate 30. Preformed cutting table 20 may be substantially free of metallic binder.

Without limiting the scope of the present disclosure, preformed cutting table 20, in one embodiment, may comprise a PDC with abrasive particles that are bound together with a carbonate (e.g., calcium carbonate, a metallic carbonate (e.g., magnesium carbonate ($MgCO_3$), barium carbonate ($BaCO_3$), strontium carbonate ($SrCO_3$), etc.) binder, etc.). Despite the extremely high pressure and extremely high temperature that are required to fabricate PDCs that include calcium carbonate binders, as this type of PDC is fabricated without a substrate (i.e., is free-standing), it may be formed with standard cutting table dimensions (e.g., diameter and thickness) in a suitable HPHT apparatus, as known in the art.

Figure 1B:
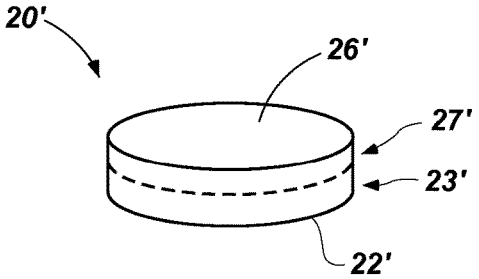
FIG. 1B depicts another specific embodiment of a preformed cutting table that may be used to manufacture a PDC cutting element in accordance with various embodiments of teachings of the present disclosure.

In another embodiment, depicted by FIG. 1B, a preformed cutting table 20' may comprise a PDC having a face portion 27' and a base portion 23'. Face portion 27' of preformed cutting table 20' is adjacent to and includes a cutting surface 26', which may be filled with silicon and/or silicon carbide. Base portion 23' of preformed cutting table 20' is adjacent to and includes a base surface 22', which consists essentially of diamond. Such an embodiment of preformed cutting element may be manufactured by removing (e.g., by leaching, electrolytic processes, etc.) cobalt or other binder material (e.g., another Group VIII metal, such as nickel or iron, or alloys including these materials, such as Ni/Co, Co/Mn, Co/Ti, Co/Ni/V, Co/Ni, Fe/Co, Fe/Mn, Fe/Ni, Fe (Ni.Cr), $Fe/Si_2$, Ni/Mn, and Ni/Cr) from face portion 27' without leaching binder material from base portion 23'. This may be accomplished, for example, by preventing exposure of base portion 23' to leaching conditions and limiting the duration of the leaching conditions. Silicon or silicon carbide is then introduced into the pores that result from the leaching process, such as by the processes described in U.S. Pat. Nos. 4,151,686 and 4,793,828, the entire disclosures of both of which are hereby incorporated herein by this reference. Thereafter, binder material may be leached from base portion 23', leaving pores therein or the binder material may remain. The porous base surface 22' is placed adjacent the surface 32 of substrate 30 (FIGS. 1 and 1A).

With returned reference to FIGS. 1 and 1A, if desired, one or more other cutter sets 12 including a preformed cutting table 20, a quantity of diamond grit particles 40 (and, optionally, binder material powder or particles 42), and a substrate 30 may then be introduced into synthesis cell assembly 50 so that a plurality of cutting elements may be manufactured with a single HTHP process. In embodiments where multiple cutter sets 12 are introduced into a single synthesis cell assembly 50, the order of components of each cutter set 12 may be reversed from the order of components of each adjacent cutter set 12. The cutter sets 12 that are located at ends 52 and 54 of a synthesis cell assembly 50 may be arranged with substrates 30 at ends 52 and 54, or as the outermost elements, to minimize impact upon and the potential for damage to the expensive preformed cutting tables 20.

Figure 2:
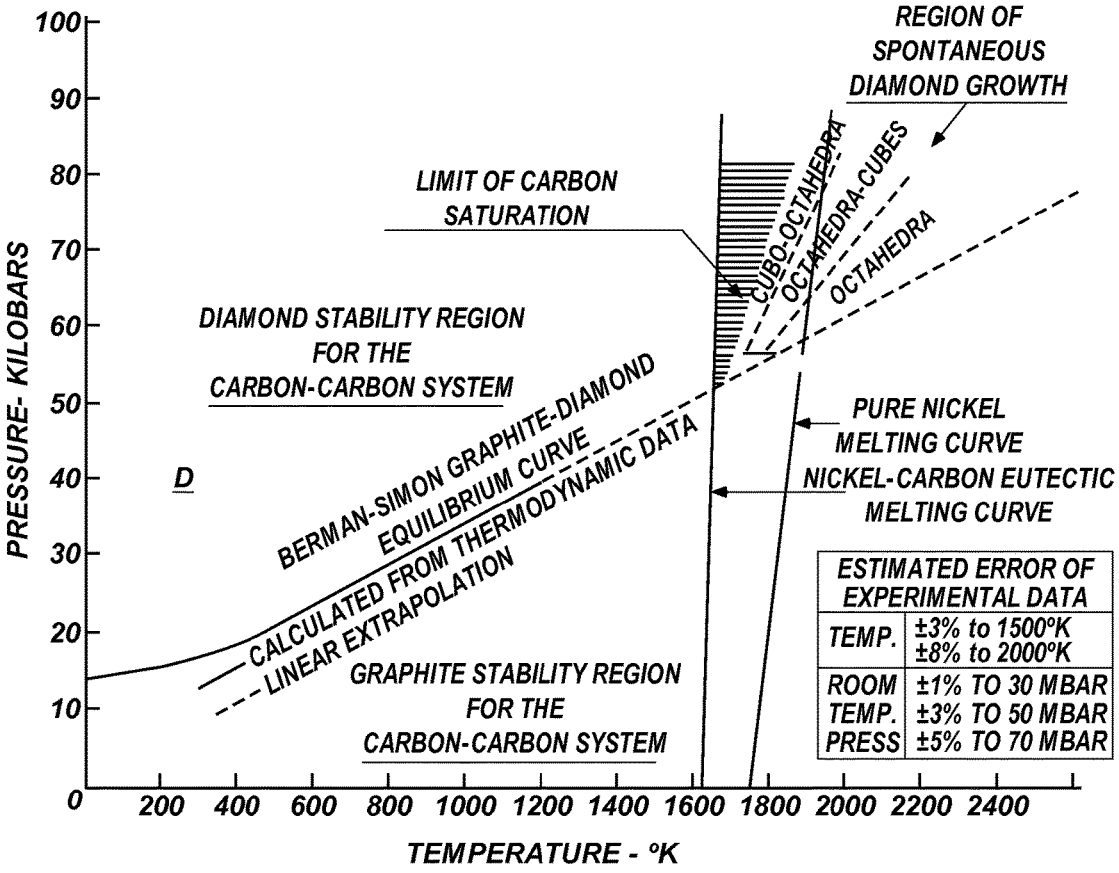
FIG. 2 is a carbon phase diagram.

Once each cutter set 12 has been assembled within synthesis cell assembly 50, the contents of synthesis cell assembly 50 may be subjected to known HTHP processes. The temperature and pressure of such processes are sufficient to cause particles 40 (and, optionally, any binder material powder or particles 42) to bind each preformed cutting table 20 within synthesis cell assembly 50 to its corresponding substrate 30. In some embodiments, the combination of temperature and pressure that are employed in the HTHP process are within the so-called "diamond stable" phase of carbon. A carbon phase diagram, which illustrates the various phases of carbon, including the diamond stable phase D, and the temperatures and pressures at which such phases occur, is provided as FIG. 2.

Figure 3:
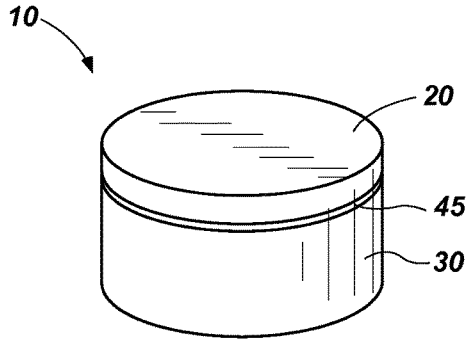
FIG. 3 depicts a PDC cutting element that includes a substrate, a preformed cutting table, and a diamond adhesion layer between the substrate and the preformed cutting table.

An embodiment of a PDC cutting element 10 resulting from such processing is shown in FIG. 3. PDC cutting element 10 includes substrate 30, a binder layer 45, and preformed cutting table 20. Binder layer 45 secures preformed cutting table 20 to substrate 30, and may be bonded to preformed cutting table 20 and integrated into the material of substrate 30 at surface 32 (see FIGS. 1 and 1A). In some embodiments, binder layer 45 consists of diamond (e.g., polycrystalline diamond (PCD)). In other embodiments, binder layer 45 consists essentially of diamond. Other embodiments of binder layer 45 include diamond and lesser amounts of a suitable binder material.

Figure 4:
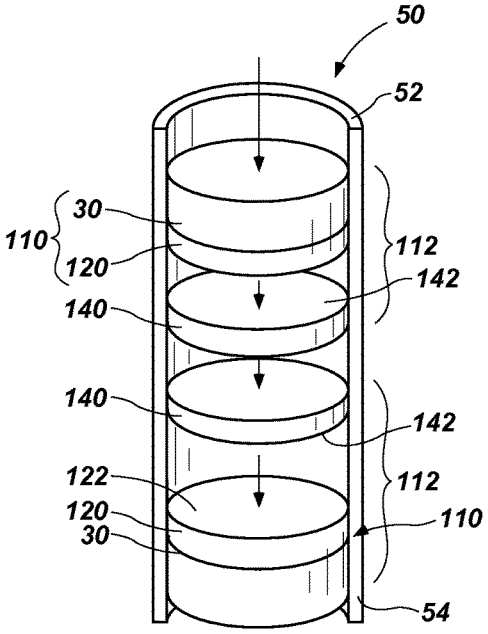
FIGS. 4 and 4A depict another embodiment of a process for manufacturing cutting elements that include preformed wafers that consist of diamond.
Figure 4A:
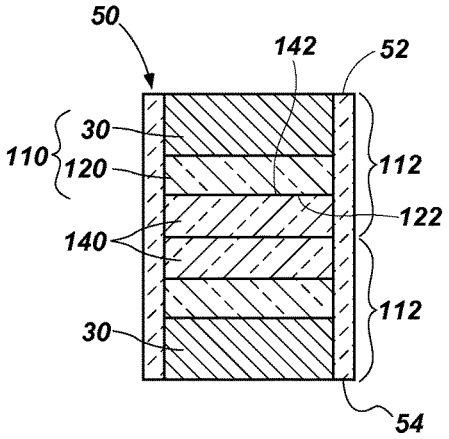

In another embodiment of a method encompassed by the present disclosure, which is shown in FIGS. 4 and 4A, at least one cutting element 110 that includes a substrate 30 with a PDC table 120 already secured thereto is introduced into a synthesis cell assembly 50.

A base surface 142 of preformed wafer 140, which may consist essentially of or consist entirely of diamond that has been deposited by known chemical vapor deposition (CVD) processes, is placed over a surface 122 of PDC table 120. Base surface 142 of preformed wafer 140 is of a complementary topography to the topography of surface 122 of PDC table 120.

As described in reference to the embodiment shown in FIGS. 1 and 1A, one or more other cutter sets 112 including a preformed wafer 140 and a cutting element 110 may be introduced into synthesis cell assembly 50 so that a plurality of cutting elements 110 may be manufactured with a single HTHP process. Once each cutter set 112 has been assembled within synthesis cell assembly 50, the contents of synthesis cell assembly 50 may be subjected to known HTHP processes, as described in reference to FIGS. 1 and 1A.

Figure 5:
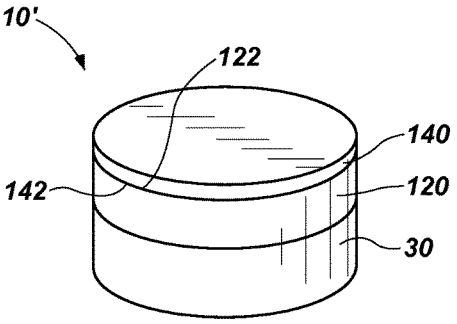
FIG. 5 illustrates an embodiment of a cutting element that includes a substrate, a PDC cutting table, and a wafer that consists of diamond atop the PDC cutting table.

An embodiment of a cutting element 10' resulting from such processing is shown in FIG. 5. Cutting element 10' includes substrate 30, a PDC table 120, and a performed wafer 140 that consists essentially of or consists of, diamond. Base surface 142 of preformed wafer 140 may be secured to surface 122 of PDC table 120 by diamond-to-diamond bonding that occurs during the HTHP process, in which diamond from preformed wafer 140 is bonded with diamond-to-diamond bonding, to diamond crystals of PDC table 120. Although the resulting structure may include cobalt or another binder material that may, if it were present on the face of preformed wafer 140, compromise thermal stability, its presence beneath preformed wafer 140 during use of cutting element 10' is at a location which is not subjected to temperatures that are known to be problematic for cutting tables that include cobalt binders.

Figure 6:
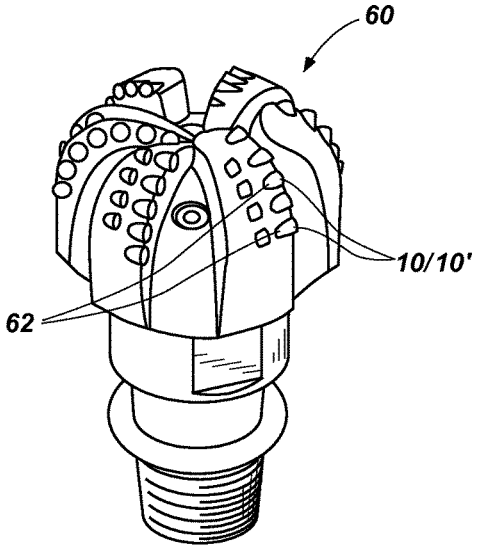
FIG. 6 shows an embodiment of an earth-boring rotary drill bit including at least one PDC cutting element that incorporates teachings of the present disclosure.

Turning now to FIG. 6, an embodiment of a rotary type, earth-boring drill bit 60 of the present disclosure is shown. Among other features that are known in the art, bit 60 includes at least one cutter pocket 62. A cutting element 10, 10' according to an embodiment of the present disclosure is received within cutter pocket 62, with substrate 30 (see FIG. 1) bonded or otherwise secured to the material of bit 60. As used herein, the term "earth-boring drill bit" includes without limitation conventional rotary fixed cutter, or "drag" bits, fixed cutter core bits, eccentric bits, bicenter bits, reamer wings, underreamers, roller cone bits, and hybrid bits including both fixed and movable cutting structures, as well as other earth-boring tools configured with cutting structures according to embodiments of the disclosure.

Although the foregoing description contains many specifics, these should not be construed as limiting the scope of the present disclosure, but merely as providing illustrations of some embodiments. Similarly, other embodiments of the disclosure may be devised which do not exceed the scope of the present disclosure. Features from different embodiments may be employed in combination. The scope of specifically claimed embodiments encompassed by this disclosure is, therefore, indicated and limited only by the appended claims and their legal equivalents, rather than by the foregoing description. All additions, deletions and modifications to the embodiments disclosed herein which fall within the meaning and scope of the claims are to be embraced thereby.

What is claimed is:

1. A method for fabricating a cutting element for use with an earth-boring drill bit, comprising:

introducing a substrate into a synthesis cell assembly;

exposing a surface of the substrate to a plurality of particles consisting of diamond particles;

introducing a preformed cutting table into the synthesis cell assembly, a base surface of the preformed cutting table in contact with the diamond particles, the preformed cutting table on an opposite side of the diamond particles from the substrate; and pressing the preformed cutting table and the substrate against one another in the presence of sufficient heat to bond the preformed cutting table to the substrate by creating diamond-to-diamond bonds between the preformed cutting table and the diamond particles and by creating bonds between the diamond particles and the substrate.

2. The method of claim 1, wherein introducing the preformed cutting table comprises introducing a preformed cutting table that is free of metal binders into the synthesis cell assembly.

3. The method of claim 2, wherein introducing the preformed cutting table comprises introducing a polycrystalline diamond compact into the synthesis cell assembly.

4. The method of claim 3, wherein introducing the preformed cutting table comprises introducing a compact including polycrystalline diamond with at least one of silicon and silicon carbide dispersed through at least a face portion of the performed cutting table.

5. The method of claim 3, wherein the polycrystalline diamond includes a carbonate binder when the polycrystalline diamond compact is introduced into the synthesis cell assembly.

6. The method of claim 1, wherein introducing the substrate into the synthesis cell assembly comprises introducing a cemented tungsten carbide substrate into the synthesis cell assembly.

7. The method of claim 1, wherein introducing the substrate into the synthesis cell assembly comprises introducing a substrate comprising a binder material into the synthesis cell assembly.

8. The method of claim 1, further comprising treating the surface of the substrate before exposing the surface to the plurality of particles consisting of diamond particles.

9. The method of claim 8, wherein treating comprises removing at least one contaminant or material that interferes with bonding of the preformed cutting table to the surface.

10. The method of claim 8, wherein treating comprises increasing at least one of an area of the surface and a porosity of the substrate at the surface.

11. The method of claim 1, wherein the plurality of particles comprises a polycrystalline diamond material when the preformed cutting table is introduced into the synthesis cell assembly, the polycrystalline diamond material consisting essentially of a matrix of diamond particles bonded to one another and a silicon, silicon carbide, or silicon and silicon carbide material located within interstitial spaces among interbonded diamond particles of the matrix of diamond particles, the plurality of particles being free of Group VIII metal or alloy catalyst material.

12. The method of claim 1, wherein the preformed cutting table comprises a polycrystalline diamond material when the preformed cutting table is introduced into the synthesis cell assembly, the polycrystalline diamond material consisting essentially of diamond particles and a carbonate binder, the preformed cutting table further including at least a face portion that is free of a Group VIII metal or alloy binder.

13. The method of claim 12, wherein introducing the preformed cutting table into the synthesis cell assembly comprises introducing the preformed cutting table into the synthesis cell assembly, wherein the carbonate binder comprises at least one of calcium carbonate, magnesium carbonate, barium carbonate, and strontium carbonate.

14. A method for fabricating a cutting element for use with an earth-boring drill bit, comprising:

disposing a substrate with a polycrystalline diamond compact on a surface thereof into a synthesis cell assembly;

exposing a surface of the polycrystalline diamond compact located on a side of the polycrystalline diamond compact opposite the substrate to a powder or particles comprising a binder material;

after exposing the surface of the polycrystalline diamond compact to the powder or particles comprising the binder material, introducing a preformed wafer consisting of diamond into the synthesis cell assembly and contacting a base surface of the preformed wafer with the polycrystalline diamond compact, the powder or particles comprising a binder material interposed between the preformed wafer and the polycrystalline diamond compact; and pressing the preformed wafer and the polycrystalline diamond compact against one another in the presence of sufficient heat to bond the preformed wafer to the polycrystalline diamond compact by creating diamond-to-diamond bonds between the preformed wafer and the polycrystalline diamond compact.

* * * * *